United States Patent [19]

Schmanski

[11] Patent Number: 4,815,713

[45] Date of Patent: Mar. 28, 1989

[54] GROUND SLEEVE MOUNT FOR SUPPORTING REMOVABLE FENCE POSTS

[75] Inventor: David A. Schmanski, Gardnerville, Nev.

[73] Assignee: Ametek, Inc., New York, N.Y.

[21] Appl. No.: 215,310

[22] Filed: Jul. 5, 1988

[51] Int. Cl.[4] ..... E04H 17/14

[52] U.S. Cl. ..... 256/19; 256/1; 52/298; 248/156

[58] Field of Search ..... 52/165, 298, 297; 256/1, 19; 248/156

[56] References Cited

U.S. PATENT DOCUMENTS

| | | | |
|---|---|---|---|
| 2,206,625 | 7/1940 | Beach et al. | 52/298 X |
| 3,630,489 | 12/1971 | Cordell, Sr. | 52/298 X |
| 4,441,679 | 4/1984 | Calet | 248/156 |
| 4,605,204 | 8/1956 | Schmanski et al. | 256/19 |

FOREIGN PATENT DOCUMENTS

| | | | |
|---|---|---|---|
| 2138048 | 10/1984 | United Kingdom | 52/165 |

*Primary Examiner*—Andrew V. Kundrat

*Attorney, Agent, or Firm*—Thorpe, North & Western

[57] ABSTRACT

A ground sleeve adapted for positioning within a back filled hole and useful for receiving and supporting an upright, broad-faced, flexible fence post for quick installation or removal. The ground sleeve includes a rectangular tubular member which has an inner diameter width slightly larger than the width of the fence post and an orthogonal thickness of inner diameter slightly larger than the fence post thickness, as measured between opposing parallel planes contacting front and rearward faces of the fence post. A top opening is provided which is squared with respect to the tube axis and opposing closing structure is positioned at the bottom of the tube to impede entry of earthen material within the tube interior. The tubular member has a thin wall structure fabricated of a flexible, resilient composition which deflects in response to compacted dirt pressed against the wall structure to a concave configuration wherein lateral edges of the fence post and at least a portion of its front or back face is in frictional contact with interior faces of the tubular member.

6 Claims, 3 Drawing Sheets

GROUND SLEEVE MOUNT FOR SUPPORTING REMOVABLE FENCE POSTS

BACKGROUND OF THE INVENTION

1. Field of the Invention

The present invention relates to a ground mounted receptacle for receiving and supporting a fence post. More particularly, this invention relates to a ground receptacle which resists unintentional dislodgment of the fence from its mounted position.

2. Prior Art

The use of temporary fencing for enclosing recreational areas is well established. For example, baseball fields are often adapted with a removable outfield fence, which permits open use of the field without limiting boundaries otherwise imposed by the perimeter fence for the ball field.

Conventional methods for removable fencing material include a tubular ground mount which is buried in the ground, and provides a receiving chamber for insertion of a rigid fence pole having attached fencing material. The fence is used by rolling it out on the ground in proximate location to the receptacles, and then raising the fence and placing the poles into appropriate ground receptacles.

A primary difficulty with such rigid fencing and post material is possible injury where a player or other person runs into the rigid pole. An outfielder, for example, chasing a fly ball may run directly into a fence wall in an effort to make a saving catch. To avoid such injuries, flexible recreational fence structures have been suggested, such as the fence system disclosed in U. S. Pat. No. 4,605,204. This fence comprises a plastic mesh which is coupled to a broad face, flexible fence post of fiberglass composition. An individual running into the flexible fence post merely rolls over or off in a manner that avoids injury. The plastic mesh also prevents scratching or other personal injury.

Prior art techniques for installing such flexible fencing materials typically involve driving the flexible posts into the ground, using an enclosing post driver. Once the fiberglass post is in position, the fence is attached to the post by ties. The fence is then left in position for the playing season, after which the fence ties are removed and the poles are pulled free from the ground. Although such a fence arrangement offers improved safety as part of the playing field enclosure, the inconvenience of retaining fencing at one position through the playing season is severely limiting. Essentially, a community must make a commitment toward utilizing a playing field as a ball diamond or soccer field, without the ability to quickly change configuration for other uses.

OBJECTS AND SUMMARY OF THE INVENTION

It is therefore an object of the present invention to provide a flexible, collapsible fencing construction which can be quickly positioned or moved to change field configurations as needed.

A further object of the present invention is to provide a removable recreational fencing construction which is stable when in place and which resists inadvertant dislodgement.

A further object of this invention is to provide a recreational fencing construction which is adapted for protection against lawn mowing equipment and other lawn care services.

DETAILED DESCRIPTION OF THE INVENTION

Figure 1:
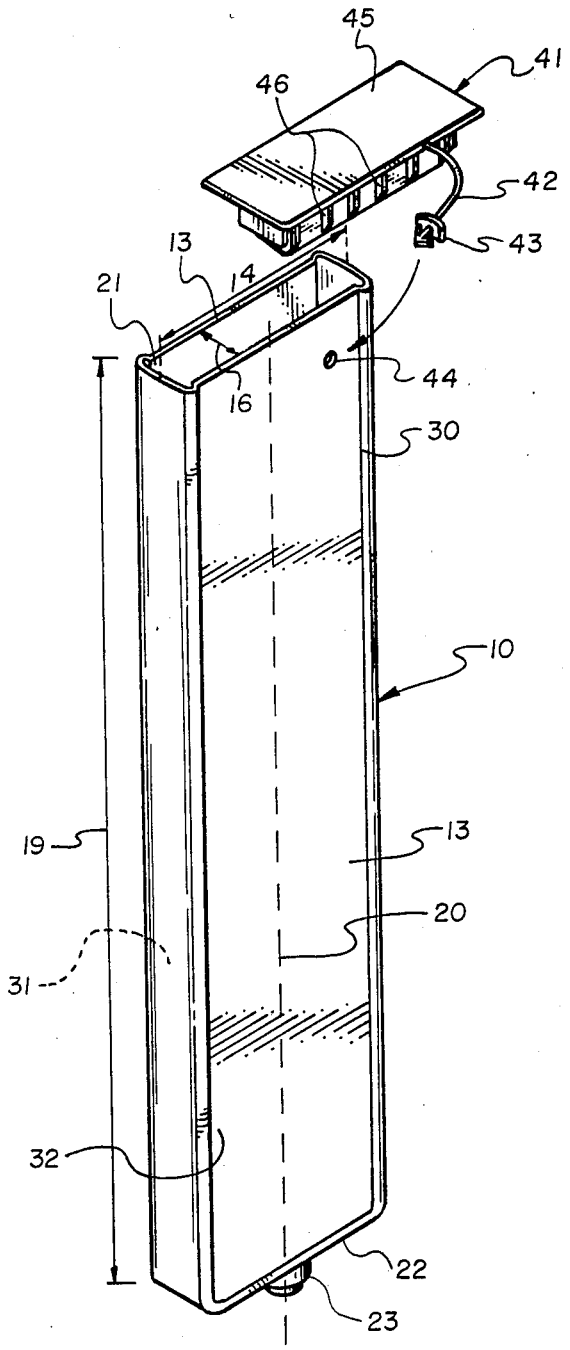
FIG. 1 shows a perspective view of a ground sleeve mount constructed in accordance with the present invention.

Referring now to the drawings:

FIG. 1 shows a ground sleeve 10 which is to be positioned within a back filled hole 11 of a playing field for receiving and supporting an upright, broad-faced flexible fence post 12 in the condition which permits quick installation or removal. The ground sleeve 10 comprises a rectangular, tubular member 13 having an inner diameter width 14 which is slightly larger than the width 15 of the fence post. The orthogonal thickness 16 (as compared with the width 14) represents an inner diameter slightly larger than the post thickness as measured between opposing parallel planes 17 and 18 contacting respective front and rearward faces of the fence. The length 19 of the sleeve is at least six inches, to ensure stable support of the fence post 12.

A top opening 21 is provided for insertion of the fence post and is formed as a substantially orthogonal cross-section with respect to the tube axis 20, such that the top opening is squared with respect to the tubular member 10. An opposing bottom end 22 provides closing structure which operates to impede entry of earthen materials into the interior portion of the tubular member. A mold stub 23 is formed as part of injection molding procedures utilized to fabricate the ground sleeve, and includes an opening (not shown) which permits drainage of captured water from within the tubular member.

Figure 3:
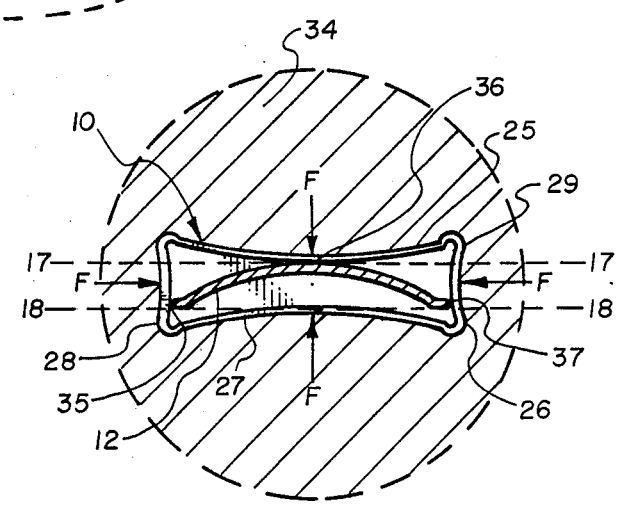
FIG. 3 is a top view of the ground sleeve with inserted post, taken along the lines 3—3.
Figure 4:
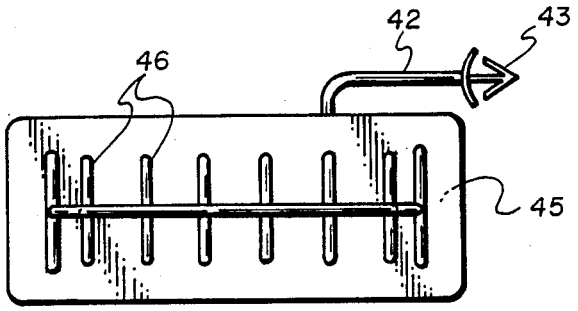
FIG. 4 is a bottom, plan view of a protective cap for use with subject ground sleeve.

A primary feature of the present invention includes the utilization of thin wall structure for the tubular wall 13. Such thin wall structure is important to provide a flexible, resilient response to compaction of dirt pressed against the wall structure. This compaction develops forces "F" at the four side walls 25, 26, 27 and 28 to deform the side walls into a concave configuration as shown in FIG. 3. The deformation of this thin wall structure is facilitated by rounded corners 29 which form a ridge 30 at the front and back faces 31 and 32.

Typically, the ground sleeve is fabricated of soft polymers such as polyethylene (low density, linear low density or medium density) and polypropylenes (EVA). With such soft polymers, the wall thickness will generally be less than five millimeters so that soil 34 compacted around the tubular member 10 deforms the wall structure in, making contact 35, 36 and 37 with the fence post 12. The frictional contact which occurs between interior faces of the tubular member and the lateral edges and front or back face of the post operates to restrain the post and attached fence 40 from pulling free from the ground sleeve when properly mounted. Furthermore, the collapsed upper section of the sleeve and surrounding compacted soil cooperate to restrain the sleeve from being pulled from the ground upon impact at the fence, or naturally ejected by frost heave, or similar natural forces.

A cap 41 may be attached to the ground sleeve 10 by means of a flexible connecting arm 42 which includes an insertable stub 43 which may be pushed through a side wall opening 44, to be retained within the tubular member. The cap 41 includes a top, cover section 45 which is contoured to prevent injury to a person stepping on the cover in bare feet. An attached plug section is formed of projecting rib structure 46 whose lateral dimensions are slightly greater than the width 14 and thickness 16 dimensions of the tubular member. Accordingly, when the cap is inserted into the tubular opening 21, the side wall structure distends to tightly grip the cap in place.

Figure 5:
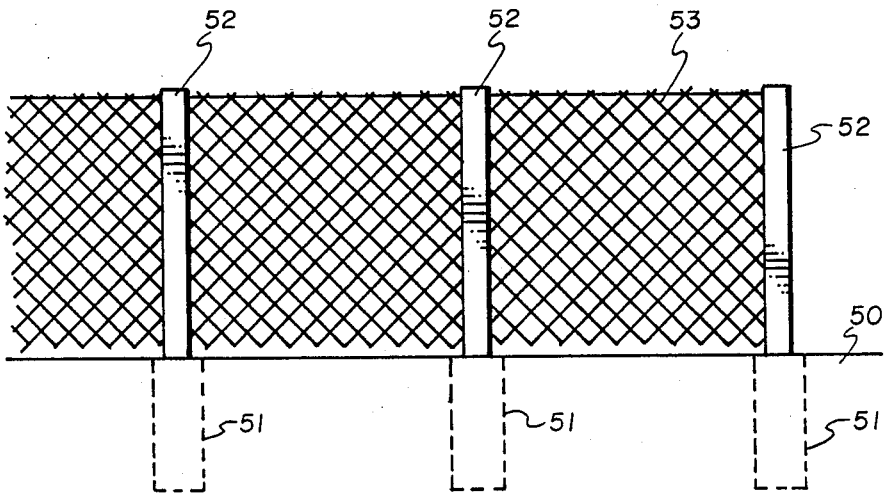
FIG. 5 is a frontal view of an installed view of an installed section of recreational fence utilizing the present invention.

A description of installation of the subject invention with an inserted recreational fence characterizes the advantage of this structure over prior art fencing methods. Installation begins by identifying a location for a fence post along an intended boundary for the playing field area. Such an area is identified in FIG. 5 as item 50 and represents any ground location on a playing field, typically one covered with grass or other ground cover. Holes 51 are dug using an auger or other device to a depth of approximately 18 inches and a minimum diameter of approximately 4 inches. Typical spacing between such holes would be approximately 8 feet. In areas where high winds are anticipated, closer spacing may be appropriate.

Figure 2:
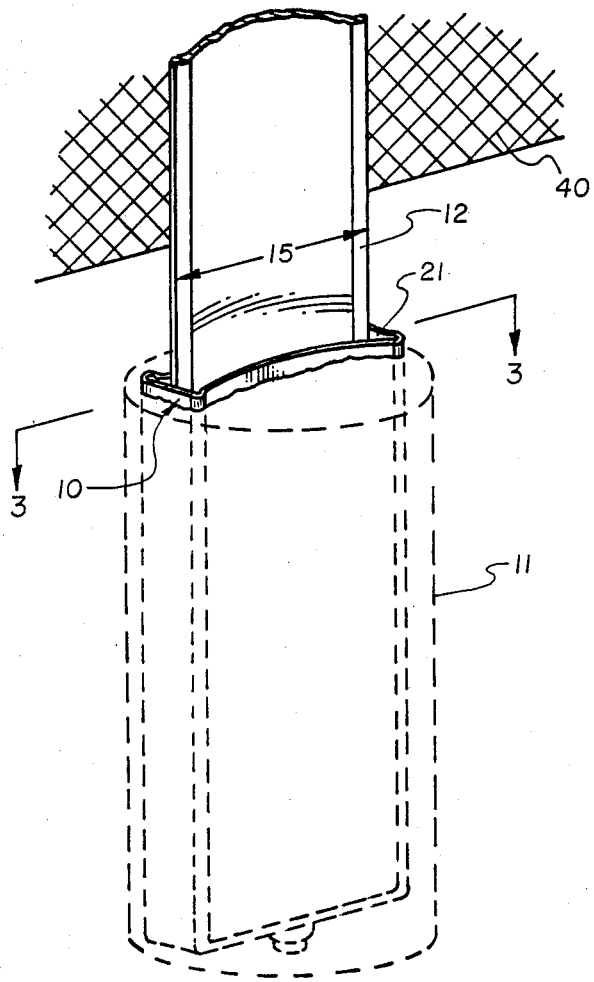
FIG. 2 shows a such a ground sleeve mount in an installed condition, with a hole and inserted ground sleeve shown in broken lines.

A fence post 52 is then slid into the ground sleeve 10 in the manner represented in FIGS. 1 and 2. With the fence post within the sleeve, the combination is inserted into the hole 51 and the post is vertically aligned in plumb position, with the top of the sleeve approximately flush with ground level. Soil is back filled into the hole around the sleeve and firmly tamped in place to deform the thin wall structure of the sleeve into the concave configuration represented in FIG. 3. Where the dimensions of the post are slightly less than the inner dimensions of the sleeve, frictional contact is created by the deforming action of the thin wall structure. This procedure is repeated with respect to each of the holes 51.

Figure 6:
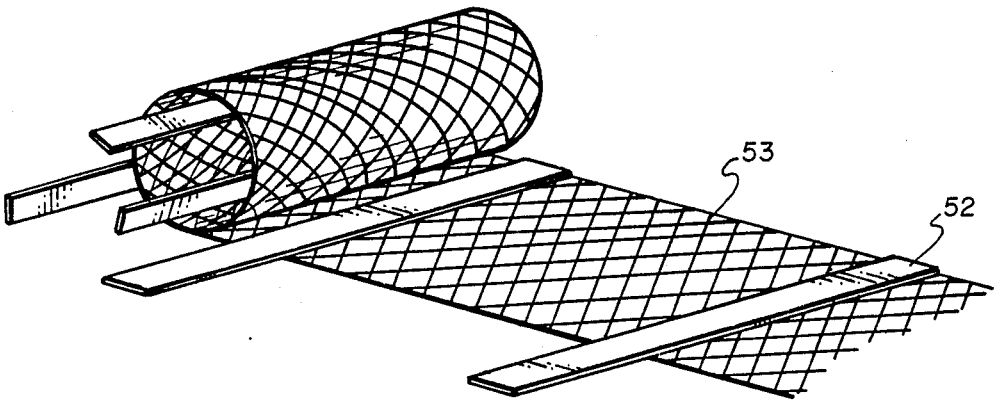
FIG. 6 shows the installed fence removed and partly rolled for storage.

With the posts 52 properly positioned, fencing material 53 is attached to the posts 52 to complete installation. If the fence is to be removed for a temporary basis, the respective posts 52 are pulled free from the ground sleeves and the fence may be rolled up as shown in FIG. 6 for storage. The collapsed upper sleeve structure prevents the ground sleeve from being extracted when the post is pulled from its seated configuration. At this point, the sleeve cap 41 is depressed into the tubular opening 21, protecting the tube interior from debris.

By virtue of the present invention, a playing field may be quickly adapted with an enclosing fence useful in dividing a large field into several different playing fields. Installation takes a matter of moments and provides a professional appearance, along with the safety of a deformable fence structure. The present invention is particularly well suited for the flat or curved fiberglass post construction and attached polymer fence material disclosed in U.S. Pat. No. 4,605,204. It will be apparent to those skilled in the art, however, that other modifications of the present invention may be developed within the general inventive concept.

I claim:

1. A ground sleeve to be positioned within a back filled hole for receiving and supporting an upright, broad-faced, flexible fence post in a quick-install-/remove configuration, said sleeve comprising:

a rectangular tubular member having an I D width slightly larger than the width of the fence post and an orthogonal thickness of inner diameter slightly larger than the post thickness as measured between opposing parallel planes contacting front and rearward faces of the fence post, said tubular member having a length of at least six inches;

a top opening of said tube being squared with respect to the tube axis to form a substantially orthogonal, exposed cross-section of the tube member;

an opposing bottom end of the tube member comprising closing structure operable to impede entry of earthen materials within an interior portion of the tubular member;

said tubular member having a thin wall structure fabricated of a flexible, resilient composition which deflects in response to compacted dirt pressed against said wall structure to a concave configuration when the tubular sleeve is positioned within the ground, wherein lateral edges of the fence post and at least a portion of its front or back face is in frictional contact with interior faces of the tubular member.

2. A ground sleeve as defined in claim 1, wherein the wall composition is selected from the group comprising polyethylene polymers and polypropylene polymers.

3. A ground sleeve as defined in claim 1, wherein wall thickness is less than approximately 5 millimeters to enhance deformation of the wall in response to compaction of surrounding soil.

4. A ground sleeve as defined in claim 1, further comprising a cap configured in size and shape for a tight fit at the top end of the tubular member.

5. A ground sleeve as defined in claim 4, further comprising a flexible connecting arm coupled between the top end of the tubular member and a portion of the cap.

6. A ground sleeve as defined in claim 1, further including a plurality of ground sleeves installed at ground surfaces on a sports field and back filled around each sleeve with compressed soil in a buried configuration, the top end of each sleeve being accessible at the ground level;

each sleeve including a flat, broad-faced flexible fence post inserted therein in upright orientation, said post having its lateral edges and at least a portion of its front or back face in frictional contact with an interior face of the tubular member;

said fence posts including fencing material attached and extending between each post.

* * * * *